US007140577B2

(12) United States Patent
Mollet et al.

(10) Patent No.: US 7,140,577 B2
(45) Date of Patent: Nov. 28, 2006

(54) REMOTE SYSTEM FOR MONITORING AND CONTROLLING RAILROAD WAYSIDE EQUIPMENT

(75) Inventors: Samuel R. Mollet, Grain Valley, MO (US); Joseph Noffsinger, Lees Summit, MO (US); David M. Davenport, Niskayuna, NY (US); John E. Hershey, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 10/820,499

(22) Filed: Apr. 8, 2004

(65) Prior Publication Data

US 2005/0253689 A1 Nov. 17, 2005

(51) Int. Cl.
*B61L 7/00* (2006.01)

(52) U.S. Cl. ..... 246/218; 246/219; 246/1 C

(58) Field of Classification Search ..... 246/121, 246/125, 131, 162, 219, 218, 220, 221, 263, 246/473 R, 473.1 R, 473.3, 477, 1 C, 253
See application file for complete search history.

(56) References Cited

U.S. PATENT DOCUMENTS 5,441,223 A * 8/1995 Young et al. ..... 246/4
6,220,552 B1 * 4/2001 Ireland ..... 246/122 R
6,688,561 B1 * 2/2004 Mollet et al. ..... 246/473.1

OTHER PUBLICATIONS

Trog, et al., "ALISTER—A Vital Interlocking System for Secondary Lines," signal + Draht International, vol. 94, May 2002, pp. 36-39.
Harmon Industries, Inc., "Signal Design and Terminology," 2003, 15 pages.

* cited by examiner

*Primary Examiner*—Mark T. Le
(74) *Attorney, Agent, or Firm*—Senniger Powers; Carlos Hanze

(57) ABSTRACT

A system for remote control of an electrically operated railroad wayside equipment having a power supply for powering the wayside equipment. a central controller provides central control signals. A transmitter associated with the controller receives the control signals and transmits communications signals corresponding to the control signals. A remote equipment controller controls operation of the wayside equipment in response thereto.

13 Claims, 10 Drawing Sheets

SIGNAL 1
POWER LINE SOURCE 506
POWER LINE TRANSCEIVER 504
CONTROLLER 502
RSDi BRIDGE 610
FIBER, COAX, RF, WAN, OR OTHER LINK 612

SIGNAL 2
POWER LINE TRANSCEIVER 604
POWER LINE SOURCE 606
RSDi BRIDGE 608

REMOTE SYSTEM FOR MONITORING AND CONTROLLING RAILROAD WAYSIDE EQUIPMENT

TECHNICAL FIELD

The invention generally relates to a point to point link between a controller and railroad equipment remote from the controller. In particular, the invention relates to a system for remotely monitoring and controlling a switched electrical power supply which powers electrically operated railroad wayside signaling equipment. Further, the invention relates to a modified power distribution system which powers railroad equipment and a remote control system monitoring and controlling the wayside equipment via the power distribution system.

BACKGROUND OF THE INVENTION

Railroad systems include wayside equipment located along the track, such as switches, signals, and vehicle detectors. A wayside equipment may be defined as, for instance, a hot box detector, a hot wheel detector, a dragging equipment detector, a high water detector, a high/wide load detector, an automatic equipment identification system, a highway crossing system, an interlocking controller system, or any other equipment located adjacent the track and used to monitor the status of the track, environment and railway vehicles. Such equipment must necessarily be located throughout the railroad system, and is thus geographically dispersed and often located at places that are difficult to access. Systems are currently in use for communicating operational and status information relating to the condition of the train or the track to control centers. For example, position indicators are provided on switches and right-of-way signals and a signal responsive to the position of a switch is communicated to a control center for that section of track.

Such wayside equipment includes visual wayside signals to provide the driver with right-of-way information not necessarily obtainable by looking down the track. Such equipment is important. Due to the limited field of view from a locomotive and the great inertia of a moving train, it is not always possible to rely on a train operator to stop a train within the range of the driver's vision.

Such wayside signals are subject to normal equipment reliability concerns. The proper operation of such equipment is important to the safe and reliable operation of the railroad. In order to reduce the probability of equipment failures, routine maintenance and inspections are performed on wayside equipment. An inspector will visit the site periodically to inspect the equipment and to confirm its proper operation. Unexpected failures may occur in spite of such efforts, and such failures may remain undetected for a period of time.

U.S. Pat. No. 5,785,283 describes a system and method for communicating operational status of train and track detecting wayside equipment to a locomotive cab. This system is directed to the reduction of radio congestion in the VHF radio system used to communicate between the wayside equipment and the locomotive. This system is described as being used for monitoring or reporting the status of grade crossing warning systems.

FIG. 1 is diagram of a prior art wayside system in which four (4) power lines supply power to signal 1 remote from the controller and four additional power lines supply power to signal 2 remote from the controller. In some installations, the distance between the controller and each signal and the distance between signal 1 and signal 2 may be significant, but limited to several thousand feet. Thus, the reliability of the signals is dependent upon the reliability of the power lines connecting the controller and the signals. In addition, the maximum distance between a controller and signal equipment is limited to the power carrying capability of the power line.

There is a need for upgraded wayside equipment to be more reliable and more easily monitored. There is also a need for upgraded wayside equipment that can be retrofitted to an existing wayside system. Further, there is also a need for an expandable, modular wayside system which can accommodate many controllers, many wayside devices and many control signals without geographic constraints. In addition, such wayside equipment and systems should have failure mode designs which default to safer or more restrictive status in the event of a malfunction or fault.

SUMMARY OF THE INVENTION

Thus, a system for remote control and monitoring of railway wayside equipment is desired.

In one embodiment, the invention comprises an apparatus for controlling and monitoring wayside equipment and is described herein as a system for remote control of an electrically operated railroad wayside equipment. The system comprises a power supply circuit for powering the wayside equipment, a central controller providing central control signals, a transmitter associated with the controller for receiving the control signals and transmitting communications signals corresponding to the control signals and at least one remote equipment controller. The remote equipment controller controls operation of the wayside equipment and has a receiver for receiving the communications signals and for generating corresponding remote control signals for controlling the wayside equipment.

In another embodiment, the invention comprises a wayside signal system comprising a plurality of signal lights, a plurality of switched power supplies, each controlling one of the signal lights, and a plurality of voltage dropping circuits. The voltage dropping circuits are connected in series and are configured such that if one or more switched power supplies controlling a less restrictive signal light is energized, a voltage applied through the voltage dropping circuits to the switched power supplies controlling more restrictive signal lights falls below a threshold voltage needed to energize the more restrictive signal lights.

In another embodiment, the invention comprises a wayside signal system comprising a plurality of signal lights, a plurality of switched power supplies, each controlling one of the signal lights, and a plurality of voltage dropping circuits. The voltage dropping circuits are connected in series and are configured such that if one or more switched power supplies controlling a less restrictive signal light is not energized, a voltage applied through the voltage dropping circuits to the switched power supplies controlling more restrictive signal lights falls above a threshold voltage needed to energize the more restrictive signal lights thereby energizing at least one of the more restrictive signal lights.

In another embodiment, the invention is a multiple signal device system for controlling a plurality of electrically operated railroad wayside signals, including a shared media bus and a first local controller for controlling the wayside signals. A first local transceiver provides signals from the first local controller to the shared media bus and provides signals from the shared media bus to the first local controller. A first signal controller controls one of the wayside signals and a first signal transceiver provides signals from the first signal controller to the shared media bus and provides signals from the shared media bus to the first signal controller. A second signal controller controls another one of the wayside signals and a second signal transceiver providing signals from the second signal controller to the shared media bus and provides signals from the shared media bus to the second signal controller.

In another form of the invention, a system controls a plurality of electrically operated railroad wayside equipment. The system includes a shared media bus, a primary controller for controlling the wayside equipment, and a plurality of multiple signal device subsystems. Each subsystem has a local controller responsive to the primary controller and communicates with a plurality of signal controllers via the shared media bus. Each signal controller controls one of the wayside equipment.

In another form, the invention is a retrofit system for an existing system having a controller switching power to a first switched power supply circuit controlling a first signaling device and switching power to a second switched power supply circuit controlling a second signaling device. The retrofit system comprises a first local power source connected to the first switched power supply circuit, a second local power source connected to the second switched power supply circuit, a first remote signal driver interface (RSDi) for controlling the first switched power supply circuit, a second RSDi for controlling the second switched power supply circuit, and a primary RSDi connected to the controller for communicating with the first RSDi and the second RSDi such that the first and second switched power supply circuits are controlled by the controller via signals from the primary RSDi communicated to the first RSDi and the second RSDi.

In another embodiment, the invention is a retrofit system for an existing system having a controller switching power over power lines to a first signaling device and switching power to a second signaling device. A first remote signal driver interface (RSDi) controls the first signaling device and is connected to the power lines. A second RSDi controls the second signaling device and is connected to the power lines. A primary RSDi connected to the controller communicates with the first RSDi and the second RSDi and is connected to the power lines such that the first and second signaling devices are controlled by the controller via signals from the primary RSDi communicated to the first RSDi and the second RSDi over the power lines.

Alternatively, the invention may comprise various other methods and apparatuses.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
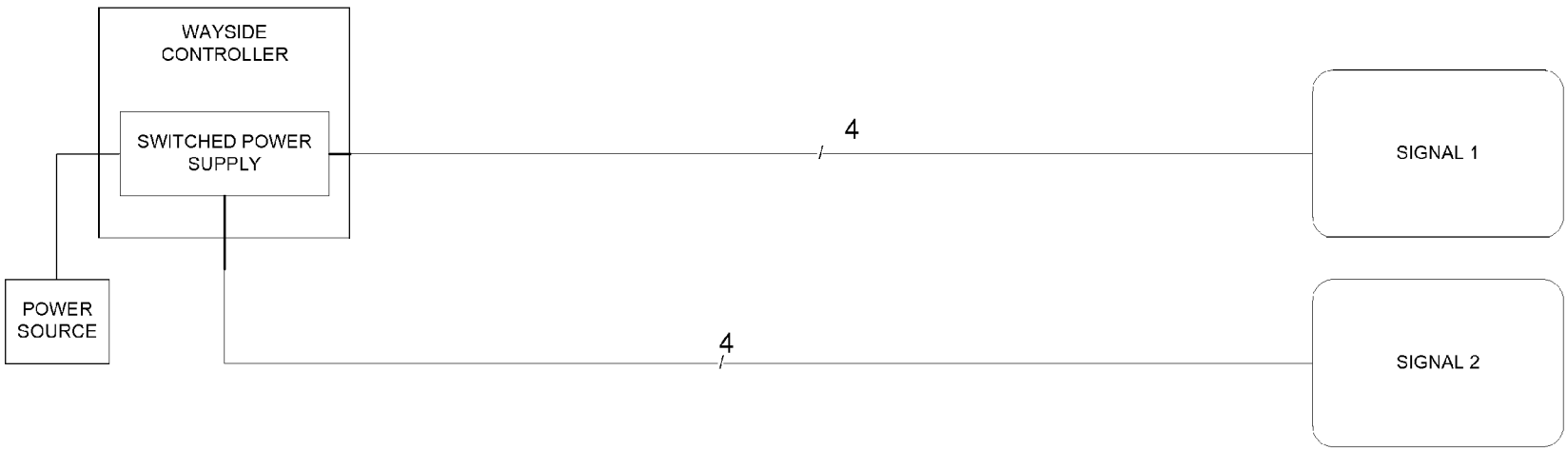
FIG. 1 PRIOR ART
FIG. 1 is diagram of a prior art wayside system in which four (4) power lines supply power to signal 1 remote from the controller and four additional power lines supply power to signal 2 remote from the controller.
Figure 2:
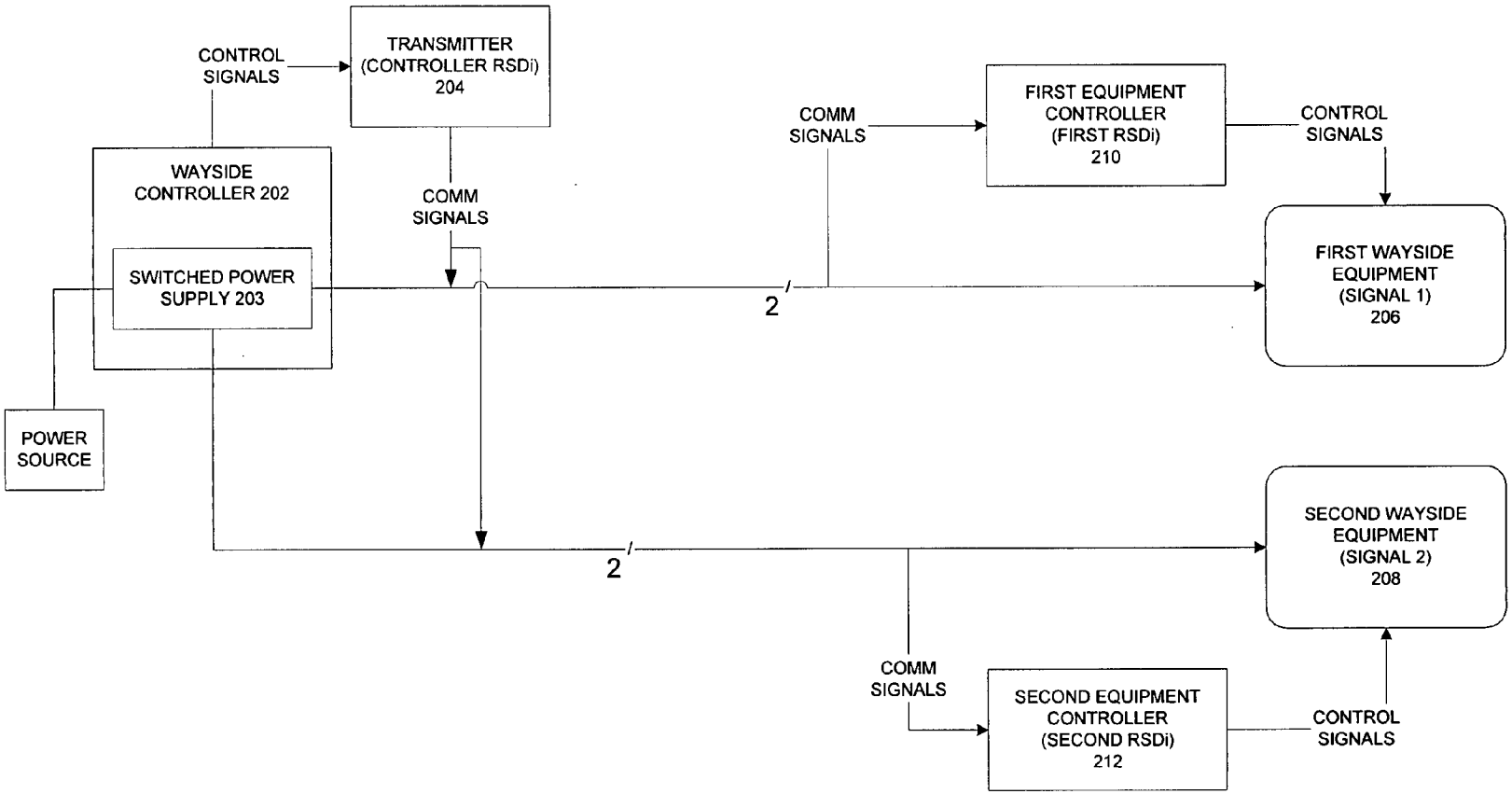
FIG. 2 is a block diagram of a remote signal driver interface (RSDi) system according to the invention which is retrofitted to the existing system of FIG. 1 employing two power lines to each signal. The power lines carry communications signals between the RSD interfaces and may optionally supply power to each signal.

Referring to FIG. 2, a block diagram of a remote signal driver interface (RSDi) system according to the invention is illustrated. In one embodiment according to the invention, it is contemplate that the system of FIG. 2 would be retrofitted to the existing prior art system of FIG. 1. In the retrofit, only two of the four power lines are employed. In addition, as noted below, the two power lines would carry communication signals between the RSDi and may optionally supply power to each signal when local power is not convenient or available.

In particular, the control signals from the controller 202 including a switched power supply 203, such as a VHLC, would be provided to a transmitter 204, such as a controller RSDi unit. The transmitter 204 would convert the control signals from the controller 202 into communication signals that would be modulated and transmitted over the two power lines as low power signals to each of a first wayside equipment (e.g., signal 1) 206 and a second wayside equipment (e.g., signal 2) 208. In addition, each wayside equipment would have an RSDi unit associated therewith. As illustrated in FIG. 2, a first equipment controller (e.g., first RSDi) 210 is associated with first wayside equipment 206 and provides control signals thereto and a second equipment controller (e.g., second RSDi) 212 is associated with the second wayside equipment 208 and provides control signals thereto.

In contrast to FIG. 1, in which the controller directly controlled a switched power supply to selectively supply power to the signal 1 and signal 2, FIG. 2 illustrates an embodiment of the invention. In the embodiment of FIG. 2, the switched power supply 203 is provides control signals to each of the wayside equipment 206, 208 and the switched power supply 203 is generally maintained in a constantly powered or ON condition so that power is continuously supplied to each of the wayside equipment.

According to FIG. 1, the controller 202 generates control signals which are used to control the switched power supply. In contrast, according to the embodiment of the invention as illustrated in FIG. 2, the control signals of controller 202 are provided to the transmitter 204 and converted to communication signals which are modulated and transmitted over the two power lines to each of the wayside equipment 206, 208. The first equipment controller 210 detects the communications signals on the two power lines and converts them into control signals which are applicable to the first wayside equipment 206. The control signals are supplied to the equipment 206 to control its operation. Since the two power lines are constantly energized, the first equipment controller 210 is able to turn ON or turn OFF the first wayside equipment 210. Similarly, the second equipment controller 212 detects the communications signals on the two power lines and converts them into control signals which are applicable to the second wayside equipment 208. The control signals are supplied to the equipment 208 to control its operation. Since the two power lines are constantly energized, the second equipment controller 212 is able to turn ON or turn OFF the second wayside equipment 208. Although FIG. 2 illustrates two power lines to each of the wayside equipment 206, 208, it is contemplated that one or more power lines could supply power to either or both wayside equipment.

Thus, FIG. 2 illustrates a system for remote control of electrically operated railroad wayside equipment 206, 208 via a two-line power supply circuit for powering the wayside equipment. Controller 202 provides control signals to transmitter 204 associated with the controller. The transmitter transmits communications signals via the power lines. Equipment controllers 210, 212 control the wayside equipment by receiving the communications signals from the transmitter and by generating corresponding control signals applied to the wayside equipment for controlling the wayside equipment.

The system of FIG. 2 also constitutes a retrofit system for the existing system of FIG. 1. The first remote signal driver interface (RSDi) unit 210 is added to control signal 1 via the power lines. The second RSDi 212 is added to control the signal 2 via the power lines. The primary RSDi 204 is connected to the controller and added for communicating with the first RSDi and the second RSDi via the power lines such that the first and second signaling devices are controlled by the controller via signals from the primary RSDI communicated to the first RSDi and the second RSDi over the power lines.

Thus, in the retrofit configuration as illustrated in FIG. 2, the number of power lines which is being used and must be maintained has been reduced from four to two and control of the wayside equipment is now significantly more dynamic as it is accomplished via RSDi units communicating with each other.

Figure 3:
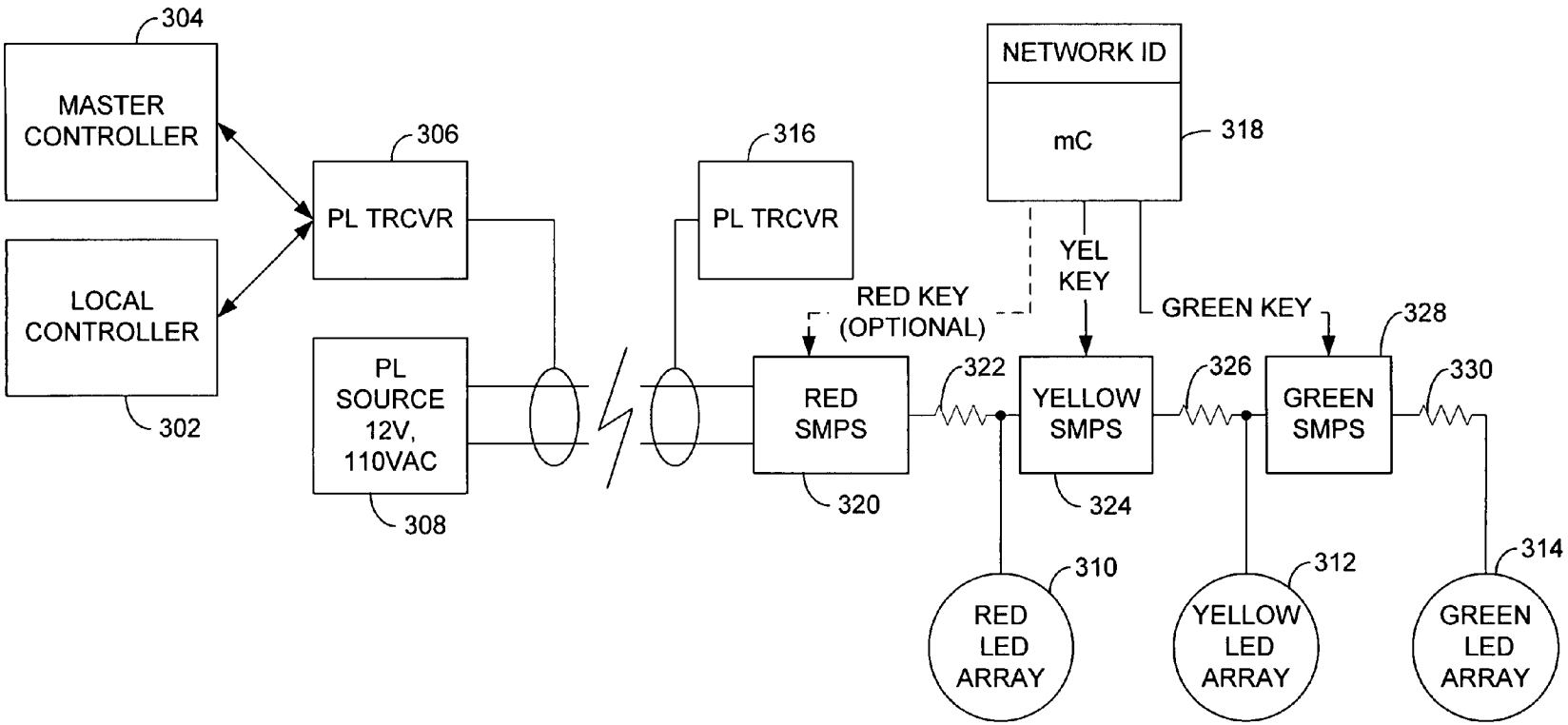
FIG. 3 is a schematic diagram illustrating one network embodiment of the invention of FIG. 2 in which two power lines carry communications signals between transceivers and also supply power to the signals.

FIG. 3 is a schematic diagram illustrating one network embodiment of the invention of FIG. 2 in which two power lines carry communication signals between transceivers and also supply power to visual signals generated by signal lights such as LED arrays or other light generating devices (e.g., electrochemical lighting). As illustrated in FIG. 3, a local controller 302 as well as a master controller 304 supply control signals to a power line transceiver 306 which converts the control signals to communication signals provided over two power lines connected to a power line source 308. In this embodiment, the power lines are directly connected to the source and are not interconnected to the switched power supply of the controller as illustrated in FIG. 2. The embodiment illustrated in FIG. 3 presents a single wayside equipment in the form of a visual signal including a red LED array 310, a yellow LED array 312 and a green LED array 314. These arrays are under the control of the communication signals modulated on the power lines and detected by the power line transceiver 316 associated with an equipment controller 318. The transceiver 316 provides control signals to the controller 318 which signals are then converted to either red key, yellow key or green key signals for controlling the red, yellow and green arrays. The power to each of the arrays is supplied by a switched mode power supply (SMPS).

In particular, a red switched mode power supply 320 is directly connected to the power line source 308 by two power lines and is switched ON and OFF by the controller 318 to supply power to the red LED array 310. A voltage dropping circuit such as a safety resistor 322 is interposed between the switched mode power supply 320 and the LED array 310 to facilitate a fail open design. In other words, the resistor 322 is configured such that if one of the other LED arrays is energized (either the yellow or green array is energized) the voltage applied to the red LED array 310 falls below a threshold voltage which is required to energize the red LED array thereby maintaining it in an inactive, non-illuminated state.

Power from the red switched mode power supply 320 is also supplied to a yellow switched mode power supply 324 for illuminating the yellow LED array 312. A voltage dropping circuit such as a safety resistor 326 is interposed between the switched mode power supply 324 and the yellow LED array 312. This again facilitates the fail open configuration. The safety resistor 326 is configured such that if the green LED array is energized, the voltage applied to the yellow LED array 312 falls below a threshold required to illuminate the yellow LED array 312. Similarly, a green switched mode power supply 328 receives power from the yellow switched mode power supply 324 and supplies power to the green LED array 314 via a voltage dropping circuit such as a safety resistor 330. Safety resistor 330 is configured such that if the green LED array 314 is illuminated the voltage applied to the yellow and red LED arrays 310, 312 is below the threshold necessary to illuminate the arrays.

Figure 4:
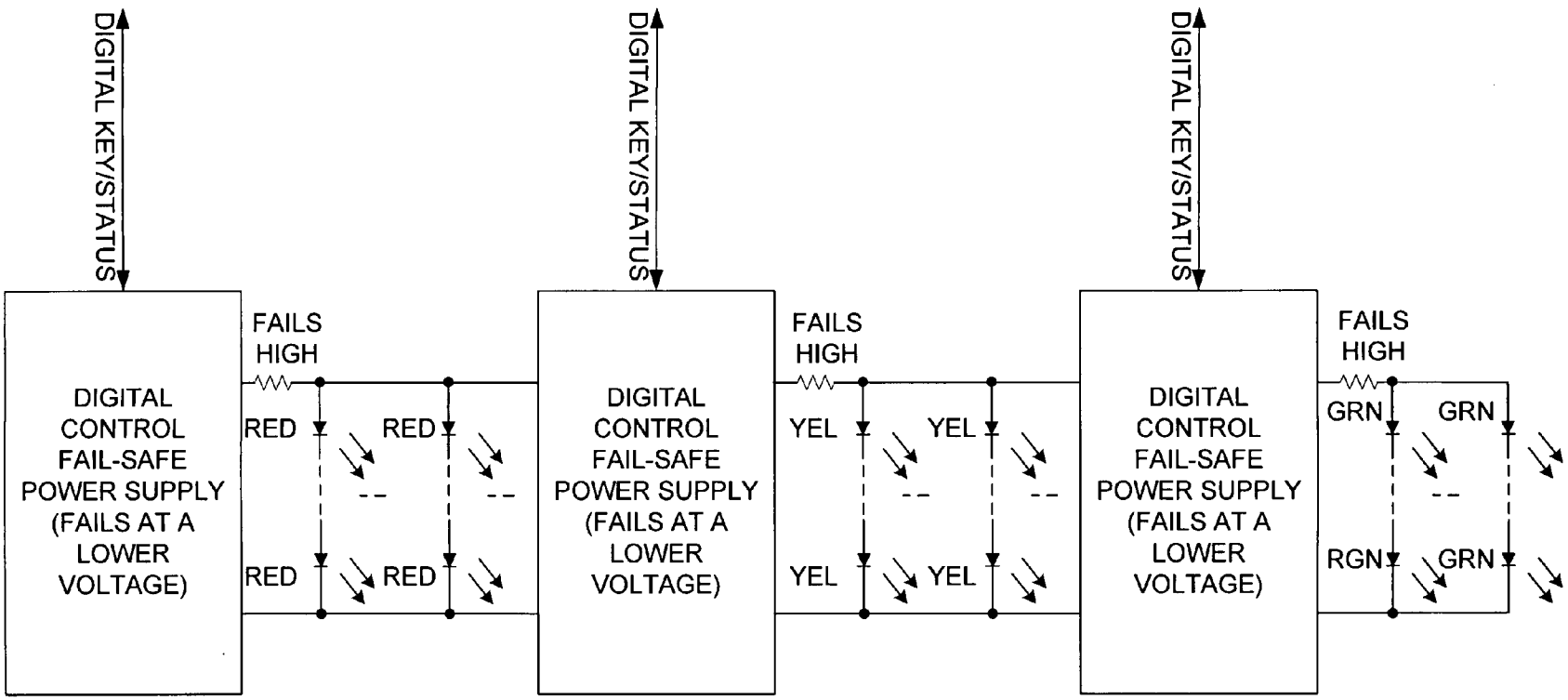
FIG. 4 is a circuit diagram of the switched mode power supplies and LED arrays of FIG. 3.

FIG. 4 is a circuit diagram of the switched mode power supplies and LED arrays of FIG. 3. In FIG. 4, each switched mode power supply comprises a digital control fail-safe power supply (such as PART NO. 226977-002 manufactured by General Electric Transportation Systems) which fails off or degrades to a lower voltage than other supplies to the right of it, which other supplies control less restrictive light signals. Each LED array is in series with a voltage dropping circuit such as a resistor that fails high. The outputs of the power supply are tailored to match the load (e.g., voltage and current requirements) of the LED or other device being illuminated or driven. Thus, the vital power supply cannot fail on, or its output cannot increase as to unintentionally turn on a more restrictive aspect. In general, any of the voltage dropping circuits herein may be implemented by any circuit including but not limited to a circuit including a semiconductor or other solid state device.

Thus, FIG. 4 illustrates a wayside signal system comprising a plurality of LED arrays and a plurality of switched power supplies, each controlling one of the LED arrays. A plurality of resistors connected in series are configured such that if one or more switched power supplies controlling a less restrictive LED array is not energized, a voltage applied through the resistors to the switched power supplies controlling more restrictive LED arrays falls above a threshold voltage needed to energize the more restrictive LED arrays thereby energizing at least one of the more restrictive LED arrays.

Figure 5A:
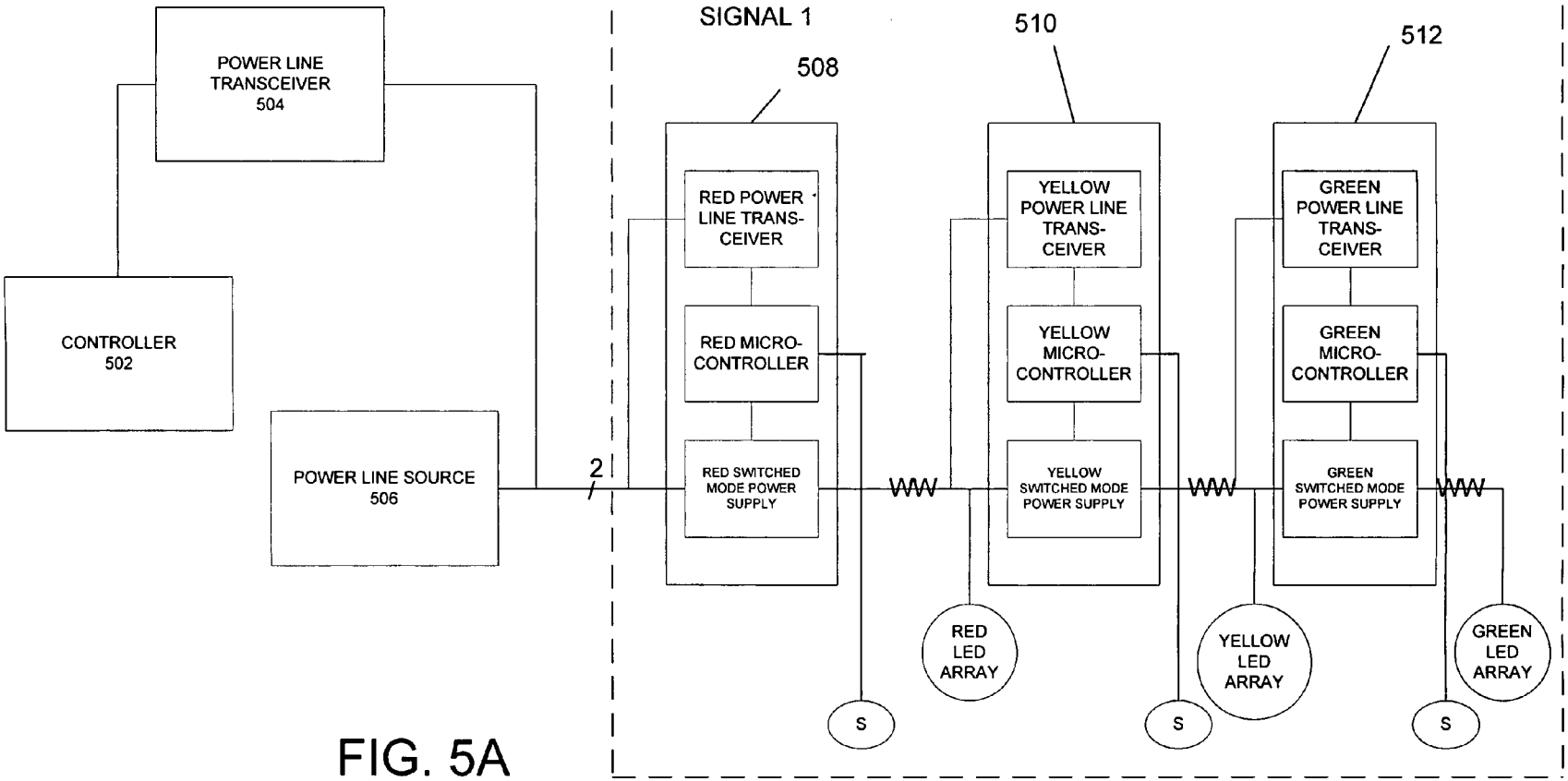
FIG. 5A is a block diagram of one embodiment of the invention which two power lines carry communications signals between transceivers and also supply power to the wayside equipment. In this embodiment, each LED array is controlled by an integrated unit including a transceiver, microcontroller and switched mode power supply. In addition, each LED array includes a sensor as a hot filament detector providing feedback to the local controller via the integrated unit.

FIG. 5A is another embodiment of the invention in which communications signals are transmitted over the power lines to provide control signal information to control SIGNAL 1. In particular, FIG. 5A is a block diagram of one embodiment of the invention in which two power lines carry communication signals between transceivers and also supply power to the wayside equipment. In this embodiment, each LED array of SIGNAL 1 is controlled by an integrated unit including a transceiver, microcontroller and switched mode power supply. In addition, each LED array includes a circuit such as a light sensor or other circuit that determines the array status (e.g., energized) either directly (e.g., by sensing light) or indirectly (e.g., by sensing electrical voltage and/or current responsive signatures), sometimes referred to as "a hot filament detector" providing feedback to the local controller via the integrated unit. In the context of LEDs, "a hot filament detector" is a misnomer since LEDs do not have filaments. Essentially, it refers to the light sensing function of the sensor or the fact that the LED array is energized.

It is also contemplated that hot swap appliances and hot stand-by appliances may be monitored or employed as part of the invention.

Referring in particular to FIG. 5, a controller 502 provides control signals to a power line transceiver 504 which converts the signals into communication signals modulated over the two power lines which are connected to the power line source 506. Reference characters 508, 510 and 512 refer to three integrated units of SIGNAL 1, each of which includes a power line and transceiver for receiving the communication signals on the power line, a microcontroller for converting the communication signals to control signals and a switched mode power supply controlled by the microcontroller for powering the red, yellow and green LED arrays. In one embodiment, the power line source 506 is local to the controller 502. In another embodiment, the power line source is remote from the controller 502 but proximate to signals 508, 510 and 512 in order to promote geographic scalability and flexibility of the system. In other words, instead of having power and control equipment in separate bungalows, a central bungalow can house control 502.

The system of FIG. 5A illustrates that the transmitter associated with the controller is a transceiver, and the sensor detects a status of the wayside equipment by providing status signals corresponding to the detected status. These status signals are transmitted as feedback signals corresponding to the status signals provided to the controller. Thus, the controller is responsive to the provided feedback signals. When the wayside equipment includes a light source, the sensor is a light detector detecting light emitted by the light source and providing status signals corresponding to the detected light to the equipment controller.

Figures 5A, 5B:
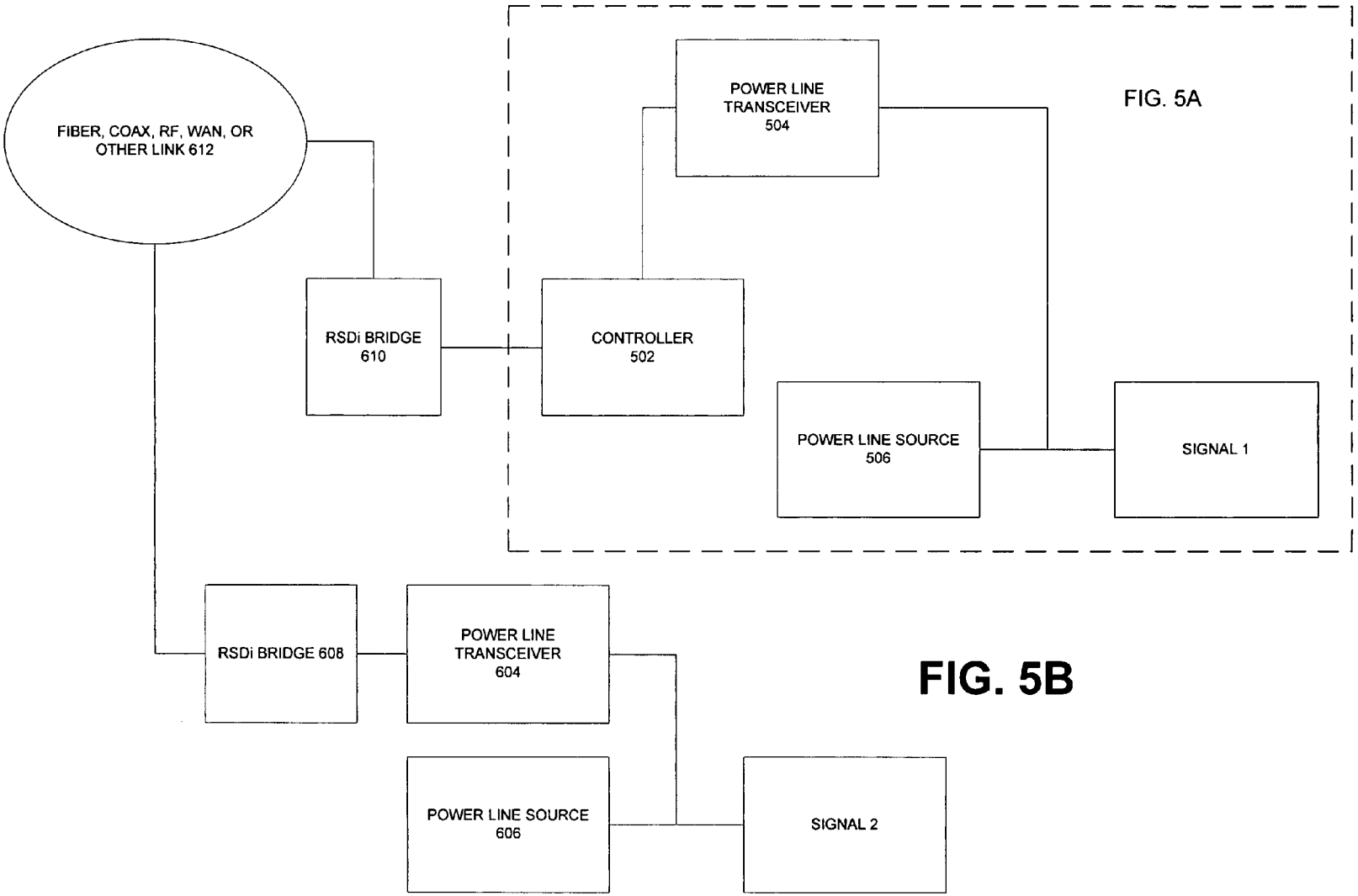
FIG. 5B is a block diagram of two systems similar to FIG. 5A operated by one controller.

As shown in FIG. 5B, it is also contemplated that the system of FIG. 5A may be linked to other, similar systems and that a separate controller would not be need to control each of the linked systems. For example, FIG. 5B shows the system of FIG. 5A including SIGNAL 1 linked to a second, similar system including SIGNAL 2. As with the system of FIG. 5A, the second system includes a power line source 606 for energizing SIGNAL 2 and a power line transceiver 604 associated therewith. An RSDi bridge 608 is associated with the transceiver 604 and is connected to an RSDi bridge 610 via a link 612 (e.g., fiber, coax, rf, WAN, or other link). Control signals from controller 502 are provided to the transceiver 604 of the second system via bridge 610, link 612 and bridge 608. The second system may be remote from the FIG. 5A system. This RSDi network bridge as shown in FIG. 5B is particularly useful for an RSDI system using local power supplies (grid drops) and power line networking.

Figure 6:
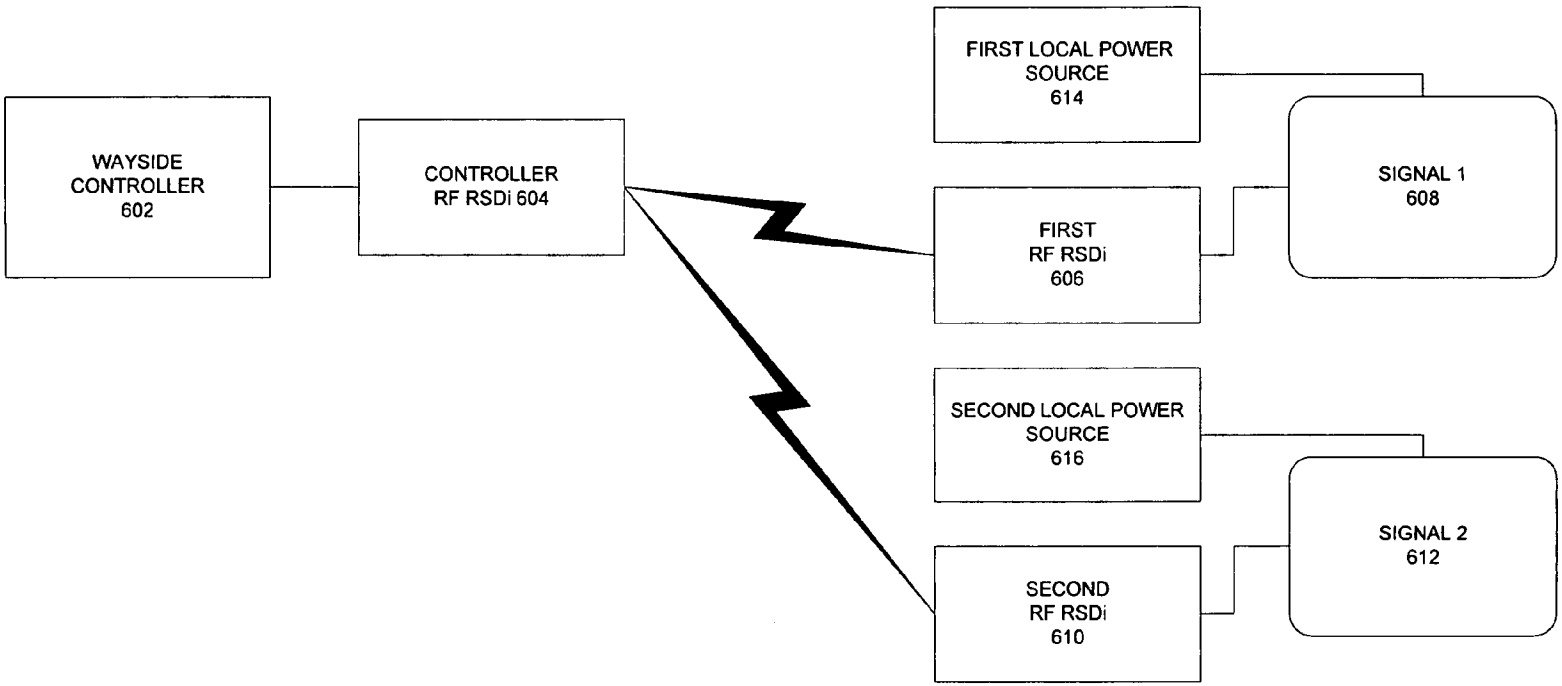
FIG. 6 is a block diagram of a remote signal driver interface (RSDi) system according to the invention which is retrofitted to the existing system of FIG. 1. The power lines for each signal have been replaced by a local power supply and the RSD interfaces use rf signals to communicate.

FIG. 6 is a block diagram of a remote signal driver interface (RSDi) system according to the invention which is retrofitted to the existing system of FIG. 1. In addition, the power lines for each of signal have been eliminated and replaced by a local power supply and the RSDi units use RF signals to communicate. In particular, the control signals from controller 602 are provided to controller RF RSDi 604 and converted into RF signals which are transmitted to a first RF RSDi 606 associated with signal 1 608 and also transmitted to a second RF RSDi 610 associated with signal 2 612. The first RF RSDi 606 controls the first signal 608 which has continuous power supplied to it via a first local power source 614. This control is implemented according to the communication signals being transmitted by the controller RF RSDi 604. Similarly, the second RF RSDi 610 controls the second signal 612 which has continuous power being supplied to it via a second local power source 616 according to the communication signals. Alternatively, the rf signals my be replaced by signals transmitted over a cable such as dedicated wire pair or a fiber optic cable which connects the RSDi devices.

From a retrofit perspective, FIG. 6 illustrates a retrofit system for an existing system (FIG. 1) having a controller switching power to a first switched power supply circuit controlling a first signaling device (signal 1) and switching power to a second switched power supply circuit controlling a second signaling device (signal 2). The first local power source 614 is added to connect to and power signal 1 and the second local power source 616 is added to connect to and power signal 2. The first remote signal driver interface (RSDi) 606 is added to control signal 1 and the second RSDi 610 is added to control signal 2. Primary RSDi 604 is added and connected to the controller 602 for communicating with the first RSDi and the second RSDi such that signals 1 and 2 are controlled by the controller via signals from the primary RSDi communicated to the first RSDi and the second RSDi.

Figure 7:
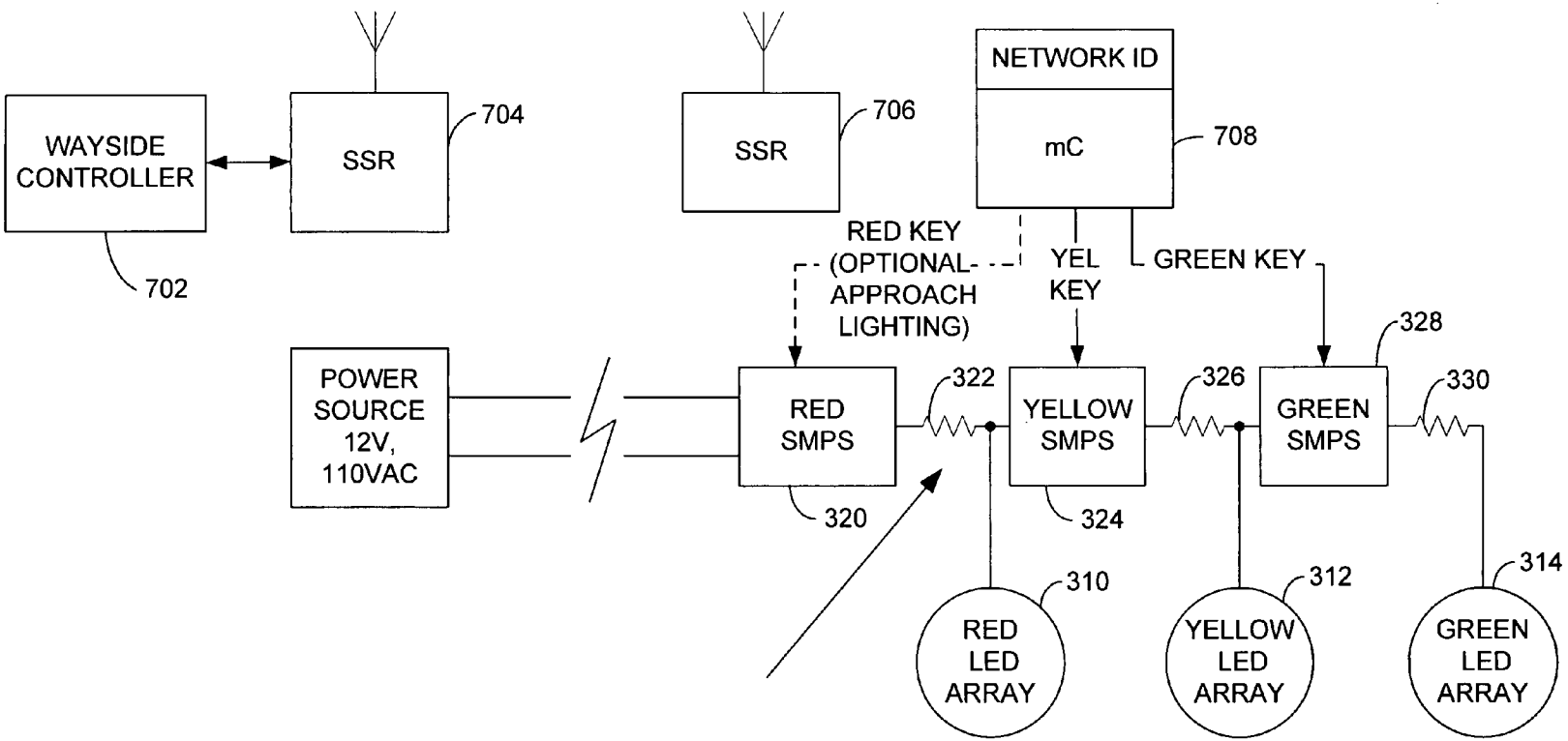
FIG. 7 is a schematic diagram illustrating one network embodiment of the invention in which two power lines supply power to the signals and in which spread spectrum radios (SSR) carry the communication signals between the local controller and the signal microcontroller.

FIG. 7 illustrates a schematic diagram of one network embodiment of the invention in which two power lines supply power to the signals and in which data radio transmitters such as spread spectrum radios (SSR) carry the communication signals between the local controller and the signal microcontroller. In particular, a controller 702 provides control signals to a controller SSR 704 which converts the signals to RF signals which are transmitted in spread spectrum format to a wayside SSR 706. The wayside SSR 706 converts the signals received into control signals which are supplied to the wayside microcontroller 708 which controls the red, yellow and green switched mode power supplies for the red, yellow and green LED arrays. As illustrated in FIG. 5, safety resistors are used to establish a fail open configuration. Power is provided continuously to each of the switched mode power supplies, which are connected in series. As with the system of FIG. 5, the system of FIG. 7 may be a retrofit to the system of FIG. 1. In addition, as illustrated in FIG. 5 sensors may be provided to provide feedback information to the wayside microcontroller 708 which information may be provided to the wayside SSR 706 for transmission to the controller SSR 704 and eventually to the controller 702.

Figure 8:
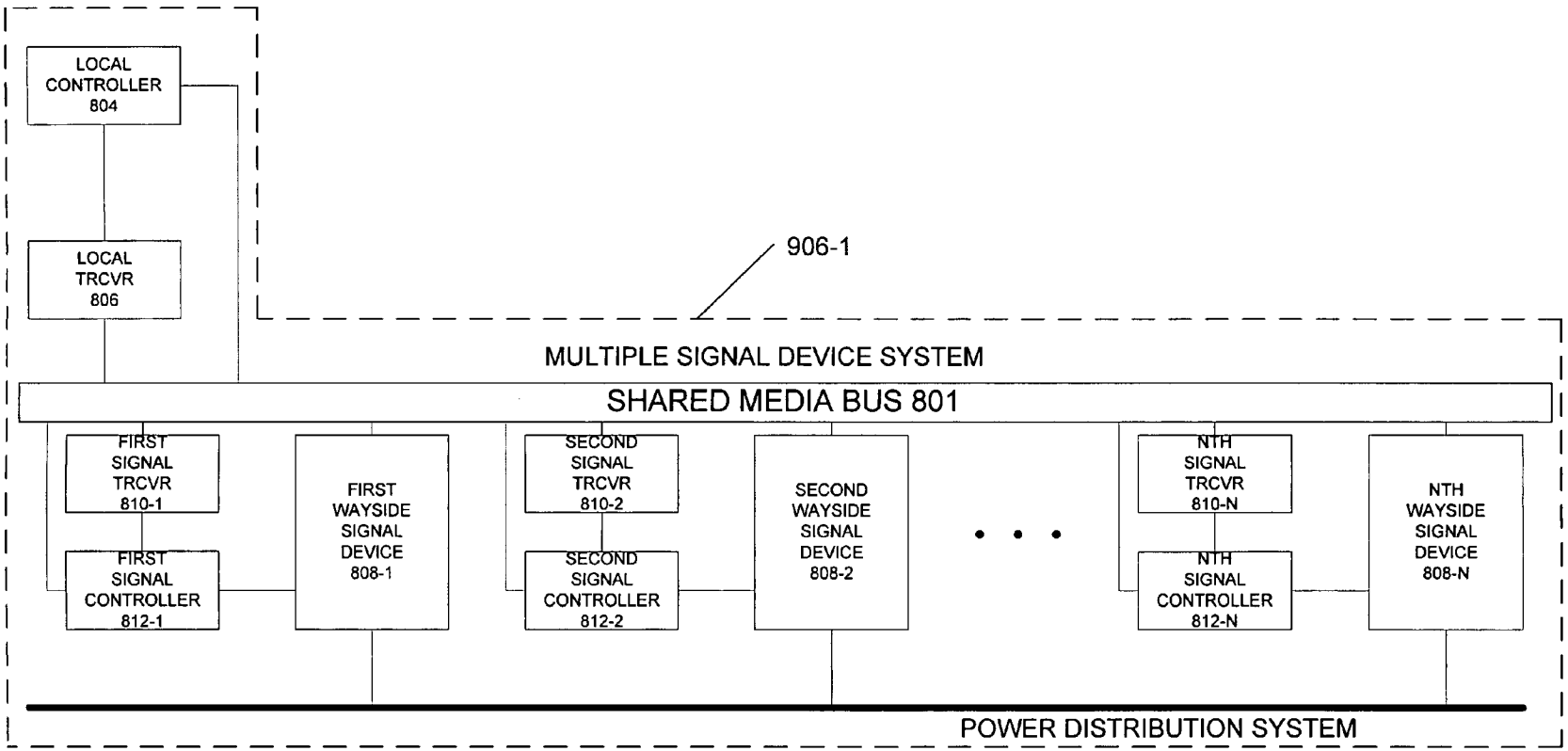
FIG. 8 is a block diagram of another embodiment of the invention in which a shared media bus carries communication signals between the local controller and the signal controller via transceivers.

FIG. 8 is block diagram of another embodiment of the invention in which a shared media bus 801 is employed to carry control signals provided by a local controller 804 via a local transceiver 806. The system of FIG. 8 includes N wayside signals 808-1 to 808-N which are controlled by the local controller 804. Local control signals are provided to local transceiver 806 from the local controller 804 and converted into local communication signals which are transmitted on the shared media bus 801. Each wayside signal device 808-1 to 808-N has a separate signal transceiver 810-1 to 810-N associated therewith which receives the local communications signals provided on the shared media bus 801 by the local transceiver 806. Each transceiver 810 converts the local communications signals into wayside control signals provided to an associated, separate signal controller 812-1 to 812-N. These wayside control signals are converted into wayside signals which are used to control the status of each of the wayside signal devices 808. Each wayside signal device 808 is separately powered by direct connection to a power distribution system which may be a network or a plurality of separate local power supplies.

In addition, it is contemplated that one or more of the signal controllers 812 and the local controller may be directly connected to the shared media bus for monitoring network traffic and for availability for control hand-off in the case of a failure.

Thus, FIG. 8 constitutes a multiple signal device system for controlling a plurality of electrically operated railroad wayside signals 808 via the shared media bus 801. Controller 804 controls the wayside signals 800 via transceiver 806 for providing signals from the controller 804 to the shared media bus 801 and for providing signals from the shared media bus to the controller. Controller 812 controls its associated the wayside signal 808 and associated transceiver 810 provides signals from the controller 812 to the shared media bus and provides signals from the shared media bus to the controller.

Figure 9:
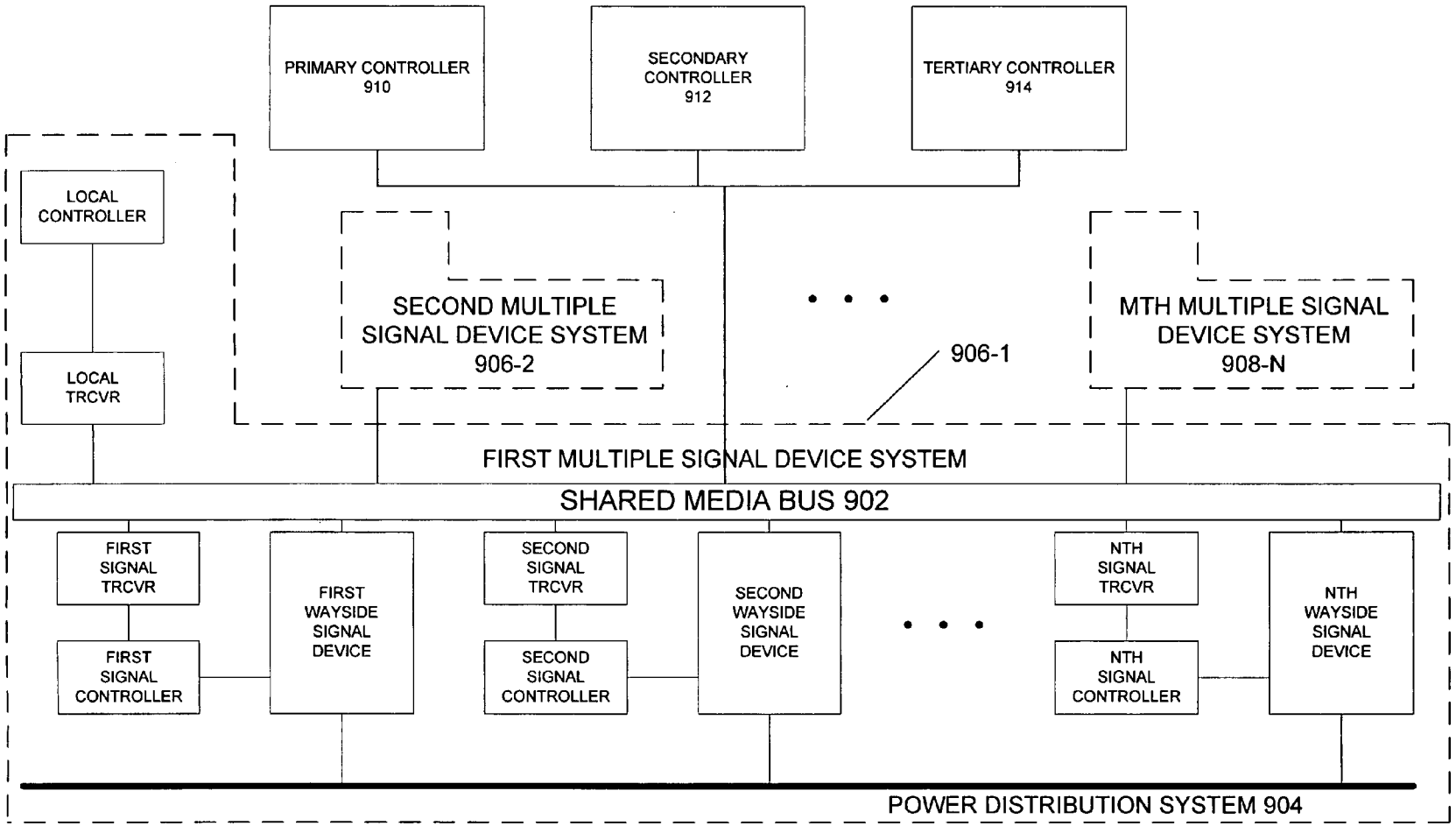
FIG. 9 is a block diagram of another embodiment of the invention wherein a shared media bus carries communication signals between the local controller and the multiple signal controllers via transceivers within a multiple signal device system, wherein the shared media bus supports a plurality of multiple signal device systems and wherein a primary, secondary and tertiary controller connected to the shared media bus communicates with the local controllers of the multiple signal device systems.

FIG. 9 is a block diagram of another embodiment of the invention wherein a shared media bus 902 carries communication signals. In this illustration, 906-1 refers to the system of FIG. 8. Additional similar systems are also connected to the shared media bus as indicated by reference characters 906-2 to 906-N. The wayside signals of each system are powered by a power distribution system 904 which may be a single integrated system or may be separate local power sources. In addition, a primary controller 910, a secondary controller 912 and one or more tertiary controllers 914 operating separately or in combination are connected to the shared media bus to communicate and/or direct the controllers of the systems 906. In addition, a traffic logging module 916 may be connected to the shared media bus for monitoring network traffic.

Thus, FIG. 9 constitutes a system for controlling a plurality of electrically operated railroad wayside signals via the shared media bus 902. One or more controllers 910, 912, 914 controlling the wayside signals. The system of FIG. 9 may have a plurality of N multiple signal device systems 906, each having a local controller responsive to the controllers 910, 912, 914 and communicating with a signal controllers via the shared media bus so that each signal controller controls one of the wayside signals.

With multiple signal devices on the shared media network, monitoring the network and log all traffic may be accomplished. Such traffic logging will allow reconstruction of the control operation conveyed by individual messages to individual signal devices. Such reconstructions may be critical in validating performance of the signaling system.

Also, with multiple signal devices on the shared media network, authenticating commands issued by the controller as well as responses received by individual signal devices is contemplated. Use of radio frequency network links may make the need for node authentication important in certain systems or environments. Network security including data encryption and user authentication may also be important. In other words, each receiver is only responsive to communication signals which are authenticated as originating from one or more designated transmitters. Alternatively, the communication signals are encrypted by the transmitter and the receiver is only responsive to encrypted communication signals. In one embodiment, the signals would be coded in a particular format so that transceivers would send signals in such a format and would only respond to signals in such a format. In another embodiment, signals would include a verification password or code so that transceivers would send signals with the password or code and would only respond to signals including the password or code.

Also, with multiple signal devices on the shared media network, there may be a need to authenticate commands issued by the controller as well as responses received by individual signal devices. Use of radio frequency network links may make the need for node authentication important in certain systems or environments. Network security including data encryption and user authentication may also be important.

ALTERNATIVE EMBODIMENTS

It is contemplated that any of the wayside equipment and/or systems noted above as well as any of the signals noted above may be any type of equipment used in connection with a railroad. It is also contemplated that any of the controlled devices such as the switched mode power supplies may receive safety critical keying signals which would be viewed as unique signals to each individual switched mode power supply. For example, a keying code scheme may be used which is orthogonal so that there is one and only one command which is acceptable to each switched mode power supply.

The sensor that may be used to sense the status of the wayside equipment may be light sensor in the case of a lamp or other visual switch or may be any other type of sensor which would relate to appliance integrity detection. Frequently such sensors are generally referred to as hot filament detectors because such sensors would detect the hot filament of a lamp. However, any kind of sensor that determines the status of a wayside piece of equipment would be contemplated. In addition, cold state sensors may also be used to confirm closed circuits or that a particular piece of equipment is not energized or that a particular piece of equipment is energized but not operational.

It is also contemplated that when the signals or wayside equipment includes lamps, local correction of lamps displayed on multiple head signals may be employed. For example, a secondary head may be downgraded on a two head signal when the top red signal is burned out. This would be a feature of the local controller architecture or such as the fail safe resistor configuration noted above which reverts to a default condition illuminating the most restrictive mode.

One advantage of the invention includes local control of each wayside equipment. For example, flashing of a lamp may be performed locally by the local microcontroller. Control signals which are transmitted to the microcontroller by a local controller or via the shared media bus may indicate the flash rate but the emulation of traditional signaling relay safety circuitry concepts would be locally programmed.

As noted above, any appliance may be employed as part of the invention such as point machines, crossing lamp controls, crossing barriers, warning sound emitting devices or any other wayside equipment, signal or light. In any case, it is also contemplated that a universal power input capability may be employed by using existing common power lines. The shared network connection would be customized for each particular piece of equipment. In this way, there would be no need to reconfigure any I/O card and application logic. Such modular configuration would lend itself to a plug and play type configuration. This also lends itself to configuring the power input capability off the power line. In addition, it enables the capability of local powering of devices and eliminates constraints on distance from a master control unit, e.g., interlocking controller to the appliance itself. Further, it eliminates some or all appliance control cables and associated testing of such cables. Integrated control of signal intensity and control of LED intensity may be accomplished by an automatic sensor by command from the master controller, e.g., interlocking controller or by time in the microcontroller clock.

It is also contemplated that many if not all of the events which transpire over the shared media bus or otherwise communicated between various controllers may be stored in a memory to provide a log of the events. For example, local logging in a non-volatile memory of RSDi events is contemplated. In addition, a global master network log may be maintained for monitoring all the various communication signals within a particular system.

Another advantage of the above aspects of the invention is that it facilitates smart appliance configurations which would predict maintenance requirements and predict schedules for when particular types of maintenance need to be performed including logging particular times. Another aspect is that it facilitates isolation. In particular, by eliminating some or all of the direct control wires, isolation for surge damage mitigation can be accomplished.

On the shared resource media bus, it is contemplated that vital signals may be multiplexed or otherwise identified for immediate delivery. In addition, various mediums may be employed for communication such as point-to-point, synchronous radio, asynchronous radio, optical free space, fiber or other venues including track-to-train or track-to-track type systems. This variety permits a safety circuit protocol and tends to reduce network traffic. One way to further reduce network traffic would be to employ a no change refresh which would periodically distribute a no change signal indicating that the particular equipment should maintain its present state. The communication protocol may also include the lowest level device addressing which reduces test and validation requirements.

The systematic interaction between systems allows the advantage of a single message to shut down or discontinue a particular event or to completely shut down the entire system and its associated equipment. This would in other words be a single message broadcast mode or an emergency signal mode in which a stop signal may be broadcast.

It is also contemplated that the individual pieces of equipment and signals may generate their own maintenance messages or requests for maintenance, all of which could be part of a multiple level priority messaging system. Geographic scaling of the control area with network extensions and gateways is also contemplated. As such, self-installing and self-configuring appliance drivers may be employed. Equipment would be in a plug and play mode in which the equipment would be installed and automatically download and install the necessary software to operate.

The geographic scaling of the control system also permits an intermediate device to be located at the signaling application site. This intermediate device can provide full control functionality as represented by the local controller in the figures. Alternatively, this intermediate device could be a communication network gateway inserted between a controller located distant to the site and the local signal control network. This gateway device provides a network interface between local and distant control points. In this manner, the primary control can be performed at a central site, far away from the specific signaling installation site.

In place of the shared media bus, control messages may be exchanged from the local controller over a wide area network to the signaling site and then converted to a network used by local signal node clusters. Another possibility is use of a gateway in parallel with resident VHLC controller. The gateway could then link a distant VHLC controller to the network which would operate as a hot-standby in case the first failed. The redundant, remote controller would monitor all control messages conveyed over the local site network and be able to rapidly assume control in the event that the local controller encountered a failure. Such a failure could be indicated via a specific message placed on the network and made available via gateway to distant redundant controller. Alternatively, the distant redundant controller could interpret a timeout of network traffic generated by the local controller (i.e. after 10 seconds of no messages on the network from local controller) as failure occurrence and then assume control functionality.

The system of the invention also is configured such that it permits for "graceful degradation" in that individual elements can fail without bringing an entire system down. This is because of the capability of zoning or of diverse or duplicate control pass including a ring structure to improve reliability. As noted above, such things as signal unit automatically safely downgrading when there is a failure of a lamp or failure of a secondary power supply.

The system employing the shared media bus also contemplates power line data transmission for handling safety critical data as well as non-safety critical data such as maintenance information, diagnostic information and logging. A conversion module to interface with the RSD appliances may be employed to provide a conventional relay or a relay emulating a logic, all of which would be a solid state system.

In addition, it is contemplated that train to wayside communication or wayside to train communication may be implemented as part of the invention including track to train and vice versa. The systems may also interface with maintenance vehicles which drive up to the system to gather information and such systems would have the ability to display special customized signal aspects, e.g., multiple flashing light sequencing lights and circulating lights. The local control of lights allows customized aspects to change or upload from the software from the host.

It is also contemplated that various communication levels within the invention may be employed. For example communications may be encrypted, may have various security levels, may require authentication of various data streams and may require validation.

One advantage of the systems as noted above is that control signals are sent as low power signals from a central wayside controller to end user devices with the end user device having a local processor for converting high level commands to local detailed actions at the end user's device site. In addition, the local power controller, i.e., the driver, provides high power management at the end user device. In addition, local sensors and monitors confirm and report end user operations and condition. The unique addressing of each local processor prevents any misunderstanding of action that needs to be taken. In addition the failure mode designs automatically default to the next restrictive operating signal status in the event of a failure. For example, as illustrated in certain embodiments above, units are hardwired to default to the proper mode.

Further implementations in the invention may be applied to crossings, including gate mechanisms, lights, bells and horns. Train inspection equipment such as hot box detectors, drag detectors and high/wide detectors may employ such aspects of the invention. As noted above, signal lights, including aspect lights and flashing lights and switch machines, may employ the configurations noted above. In one aspect of the invention the various features are retrofitted to existing installations with control signals being provided over the existing power lines or via RF, as noted above. New installations would include unteathered locations or previously available locations which have localized power, which have remote communications via wireless or satellite and which provide inexpensive construction by installing a single controller bus for multiple end use devices at a location instead of multiple high power lines, one line from the central controller for each user device. For example, one line for each light on a three light aspect signal would be avoided.

The order of execution or performance of the methods illustrated and described herein is not essential, unless otherwise specified. That is, elements of the methods may be performed in any order, unless otherwise specified, and that the methods may include more or less elements than those disclosed herein.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A system for remote control of an electrically operated railroad wayside equipment having a power supply for powering the wayside equipment, said power supply providing power to the way side equipment via four preexisting power lines, and said system comprising:

a central controller providing central control signals;

a transmitter associated with the controller for receiving the control signals and converting the control signals into communications signals that are transmitted through only two of said four power lines to the way side equipment; and at least one remote equipment controller controlling operation of the wayside equipment, said equipment controller having a receiver connected to at least one of the two power lines for receiving at least one of the communications signals and for generating corresponding remote control signals for controlling the wayside equipment.

2. The system of claim 1 wherein the receiver is only responsive to communication signals which are authenticated as originating from the transmitter.

3. The system of claim 1 wherein the communication signals are encrypted by the transmitter and the receiver is only responsive to encrypted communication signals.

4. The system of claim 1 for controlling an additional electrically operated railroad wayside equipment, said system further comprising:

another equipment controller controlling the additional wayside equipment, said another equipment controller for receiving the communications signals from the transmitter and for generating corresponding control signals for controlling the additional wayside equipment.

5. The system of claim 4 wherein the transmitter is a controller remote signal driver interface (RSDi), wherein the equipment controller is a first RSDi, wherein the another equipment controller is a second RSDi, and wherein the communications signals are transmitted over the power lines connecting the controller RSDi, the first RSDi and the second RSDi.

6. The system of claim 4 wherein said transmitter, said receiver, said controller and said equipment controller together constitute a retrofit kit for use with the switched power supply and for use with an existing power line that supplies power to the railroad wayside equipment via the existing switched power supply.

7. The system of claim 4 wherein the wayside equipment comprises a plurality of signal lights, a plurality of switched power supplies, each controlling one of the signal lights, and a plurality of voltage dropping circuits, all connected in series.

8. The system of claim 7 wherein the voltage dropping circuits are resistors configured such that if one or more switched power supplies controlling a less restrictive signal light is energized, a voltage applied through the resistors to the switched power supplies controlling the more restrictive signal lights falls below a threshold voltage needed to energize the more restrictive signal lights.

9. The system of claim 8 wherein the resistors are configured such that if one or more switched power supplies controlling a less restrictive signal light is not energized, a voltage applied though the resistors to the switched power supplies controlling more restrictive signal lights is above a threshold voltage needed to energize the more restrictive signal lights thereby energizing at least one of the more restrictive signal light.

10. The system of claim 1 wherein the wayside equipment includes a switched power supply for controlling the wayside equipment and at least one of the power lines supplies power to the switched power supply; wherein the transmitter comprises a power line transmitter associated with the at least one of the power lines, said power line transmitter transmitting the communications signals over the at least one of the power lines; and wherein the equipment controller comprises a power line receiver associated with the at least one of the power lines, said second power line receiver receiving the first communications signals via the power line.

11. The system of claim 1 wherein the transmitter is a first transceiver and wherein the equipment controller is a second transceiver integrated with a switched power supply for controlling the wayside equipment.

12. The system of claim 1 wherein the transmitter associated with the controller is a transceiver, and further comprising a sensor detecting a status of the wayside equipment and providing status signals corresponding to the detected status to the equipment controller, wherein said equipment controller provides feedback signals to the transceiver, said feedback signals corresponding to the status signals, wherein the transmitter provides signals corresponding to the feedback signals to the controller, and wherein the controller is responsive to the provided signals.

13. The system of claim 1 wherein the transmitter associated with the controller is a transceiver, wherein the wayside equipment includes a light source and further comprising a light detector detecting light emitted by the light source and providing status signals corresponding to the detected light to the equipment controller, wherein said equipment controller provides feedback signals to the transceiver, said feedback signals corresponding to the status signals, wherein the transceiver provides signals corresponding to the feedback signals to the controller, and wherein the controller is responsive to the provided signals.

* * * * *